US005104459A

United States Patent [19]

Chen et al.

[11] Patent Number: 5,104,459

[45] Date of Patent: Apr. 14, 1992

[54] METHOD OF FORMING ALUMINUM ALLOY SHEET

[75] Inventors: Lian Chen, Louisville; James G. Morris, Lexington; Subodh K. Das, Prospect, all of Ky.

[73] Assignee: Atlantic Richfield Company, Los Angeles, Calif.

[21] Appl. No.: 656,528

[22] Filed: Feb. 19, 1991

Related U.S. Application Data

[63] Continuation-in-part of Ser. No. 442,131, Nov. 28, 1989, abandoned.

[51] Int. Cl.[5] ..... C22F 1/00

[52] U.S. Cl. ..... 148/11.5 A; 148/437

[58] Field of Search ..... 148/11.5 A, 437

[56] References Cited

U.S. PATENT DOCUMENTS

| | | | |
|---|---|---|---|
| 4,282,044 | 8/1981 | Robertson et al. | 148/11.5 A |
| 4,431,463 | 2/1984 | Althoff | 148/11.5 A |
| 4,517,034 | 5/1985 | Merchant et al. | 148/11.5 A |
| 4,605,448 | 8/1986 | Baba et al. | 148/11.5 A |
| 4,718,948 | 1/1988 | Komatsubara et al. | 148/2 |
| 4,832,223 | 5/1989 | Kalenak et al. | 220/66 |
| 4,855,107 | 8/1989 | Teirlinck et al. | 148/11.5 A |

*Primary Examiner*—Upendra Roy

*Attorney, Agent, or Firm*—Randall C. Brown

[57] ABSTRACT

Methods for the improvement of mechanical properties of aluminum can stock materials. In one method, an aluminum alloy is cast into an ingot, heated at an elevated temperature to homogenize the alloy, hot rolled at an elevated temperature to form hot band material and cold rolled to final gauge. After the heating step, the alloy is hot rolled immediately to minimize the cooling of the alloy between the heating and hot rolling steps.

10 Claims, 4 Drawing Sheets

METHOD OF FORMING ALUMINUM ALLOY SHEET

CROSS-REFERENCE TO RELATED PATENT APPLICATIONS

This application is a continuation in part of patent application Ser. No. 07/442,131 filed Nov. 28, 1989, abandoned, the entire disclosure of which is incorporated herein by reference.

BACKGROUND OF THE INVENTION

1. Field of the Invention

The present invention relates to methods for the improvement of mechanical properties of aluminum can body stock and end stock material. More particularly, the present invention relates to methods for improving the yield strength and in some cases the yield strength and earing of aluminum can body stock and end stock alloys.

2. Description of the Prior Art

The materials most commonly used in the manufacture of drawn and ironed beverage containers are the Aluminum Association Specification AA 3XXX (where X represents an integer from zero to nine) series of aluminum alloys. This series of alloys is known as the AA 3000 series of alloys. The alloys in this series contain manganese and are strengthened primarily by the formation of second phase precipitate particles.

The materials most commonly used in the manufacture of metal beverage container ends and closures are the Aluminum Association Specification AA 5XXX (where X represents an integer from zero to nine) series of aluminum alloys. This series of alloys is known as the AA 5000 series of alloys. This series of alloys is characterized by a solid solution of alloying elements (primarily magnesium) which confers a strength higher than that of unalloyed aluminum. Alloys of this series are, in general, stronger but less formable than those of the AA 3000 series and generally exhibit higher work-hardening rates.

The AA 3000 series of aluminum alloys is of considerable economic importance in the metal beverage container packaging industry. For instance, in 1988, 3.7 billion pounds of the AA 3004 aluminum alloy, a member of the AA 3000 series, were used in metal beverage container production. This use represents the largest single use of aluminum and its alloys. Increased demand from the metal beverage container packaging industry for aluminum cans has created a considerable need for aluminum alloy sheet material for forming the can body and end portions that is economical to manufacture and possesses a combination of desirable formability and strength properties. Thus, it would be quite advantageous to produce aluminum alloy sheet material having improved yield strength and in some cases improved yield strength and improved earing.

According to conventional processes for producing aluminum alloy sheet material that is subsequently deep drawn and ironed into beverage cans, the aluminum alloy material is initially cast by strip or direct chill casting processes into an ingot having a thickness of about 20–30 inches. The ingot is then homogenized by a two step process, in which the ingot is first heated at a temperature of 1125° F. for four hours and is then heated at a temperature of 975° F. for 2 hours. The homogenized ingot is then hot rolled to a thickness of from 0.080 to 0.130 inches to form the hot band material. Next, the hot band material is annealed at a temperature of from 600° to 900° F. to effect softening and recrystallization of the aluminum alloy material. The material is then cold rolled 80–90% to its final thickness to produce material having a super hard temper known as the Aluminum Association Specification H19 temper.

The major mechanical properties of the AA 3000 series of aluminum alloys such as the AA 3004 alloy in the H 19 condition are a yield strength after baking of about 35 ksi and earing of about 2.0%.

The present invention has been developed with a view to providing processes for producing aluminum alloy sheet material having improved mechanical properties.

SUMMARY OF THE INVENTION

The present invention provides a method for producing aluminum alloy sheet material having improved mechanical properties. In accordance with one aspect of the present invention, a method for producing aluminum alloy sheet material is provided in which conventional hot band material is annealed at an increased temperature and then cold rolled to final gauge. The annealing is conducted at a temperature of from about 1000 to about 1160° F., preferably from about 1100 to about 1150° F. and most preferably from about 1120 to about 1130° F. for up to 24 hours, preferably for up to 4 hours and most preferably for up to 2 hours. Surprisingly, for the AA 3004 alloy, this process results in aluminum alloy sheet material having improved after bake yield strength and earing.

For the AA 3104 alloy, this process results in aluminum alloy sheet material having improved after bake yield strength and unchanged earing.

In accordance with another aspect of the invention, a method for producing aluminum alloy sheet material is provided in which as cast aluminum alloy material is homogenized by a one step process at a temperature of from about 1000 to about 1160° F., preferably from about 1100 to about 1150° F. and most preferably from about 1120° to about 1130° F. for up to 24 hours, preferably for up to 4 hours and most preferably for up to 2 hours. After homogenization the material is immediately hot rolled. The hot rolled material is then cold rolled to final guage. Optionally, the hot rolled material may be annealed at about 700° F. for two hours before cold rolling. The process results in aluminum alloy sheet material having improved after bake yield strength.

In accordance with still another aspect of the invention, a method for producing aluminum alloy sheet material is provided in which an aluminum alloy is cast into an ingot and the ingot is heated at a temperature of from about 1000° to about 1150° F., preferably about 1125° F., for a period of at least 2 hours, preferably about 4 hours, to homogenize the aluminum alloy. The alloy is then hot rolled at a temperature of from about 1000° to about 1150° F. to form hot band material. After the heating step, the alloy is hot rolled immediately to minimize the cooling of the alloy between the heating and hot rolling steps. In any event, the alloy is not allowed to cool below about 1000° F. between the heating and hot rolling steps. The hot rolled material is then cold rolled to final gauge. According to this method the aluminum alloy has the following composition: about 0.75 to about 1.15% by weight manganese, about 0.95 to about 1.45% by weight magnesium, about 0.30 to about 0.45% by weight iron, about 0.15 to about 0.25% by weight silicon, about 0.12 to about 0.25% by weight copper, up to about 0.1% by weight chromium, up to about 0.1% by weight zinc, up to about 0.1% by weight titanium and the balance being aluminum. The process results in an aluminum alloy sheet material having improved after bake yield strength.

In accordance with all aspects of the invention, the cold rolled aluminum alloy sheet material may be utilized as aluminum can body stock. Moreover, according to all aspects of the invention, the cold rolled aluminum alloy sheet material may be subjected to conventional cleaning, coating and waxing processes to prepare aluminum alloy sheet material that may be utilized as aluminum can end stock.

BRIEF DESCRIPTION OF THE DRAWINGS

The above brief description as well as further objects, features and advantages of the present invention will be more fully appreciated by reference to the following detailed description of presently preferred but nonetheless illustrative embodiments in accordance with the present invention when taken in conjunction with the accompanying drawings wherein.

DESCRIPTION OF PREFERRED EMBODIMENTS

Figure 1:
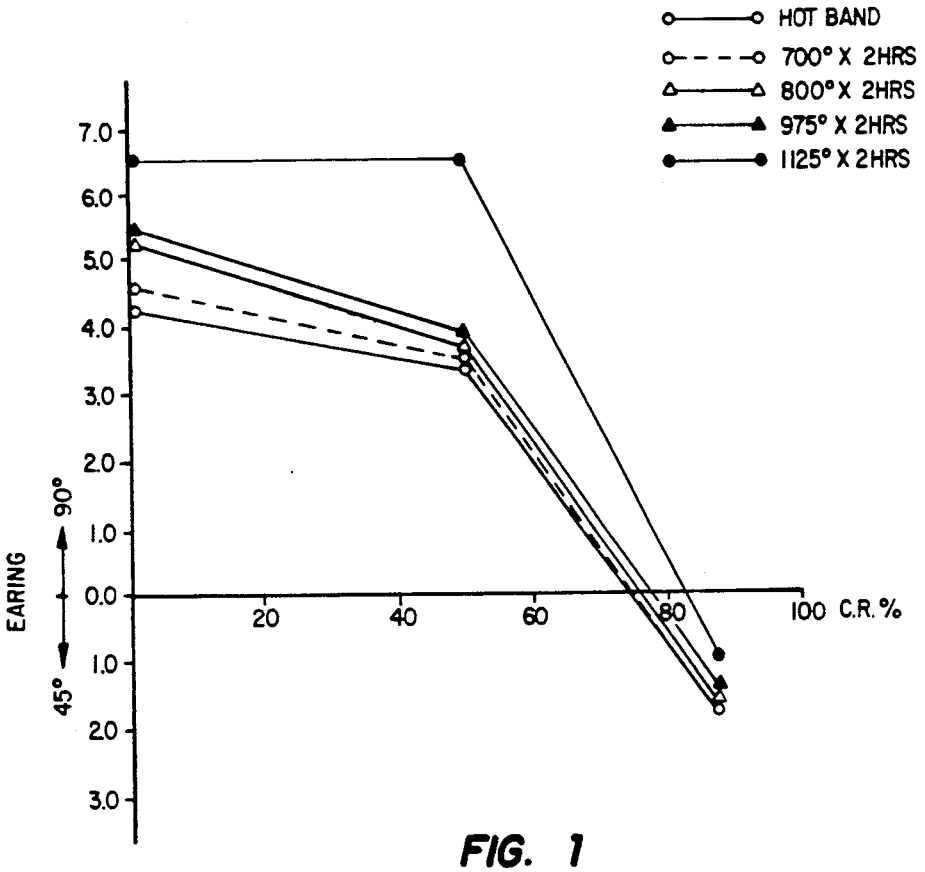
FIG. 1 is a graph of earing versus percent cold rolling for various samples of the AA 3004 aluminum alloy.

As discussed above, the AA 3000 series of aluminum alloys are of considerable economic importance in the metal beverage container packaging industry. Aluminum manganese alloys such as the AA 3004 alloy demonstrate mechanical anisotropic behavior that must be controlled to produce body stock and end stock material for use in metal beverage container packaging. The mechanical anisotropy of the AA 3004 aluminum alloy is manifested in its earing behavior.

The production of body stock and end stock material for use in metal beverage container packaging also requires that the material possess a sufficient amount of strength in terms of tensile yield strength to maintain its integrity as a container structure.

It has been found that the earing behavior and the strength of the alloy material depend largely on the disposition of the manganese solute in the alloy. An ideal structure in terms of earing behavior is one in which all the solute is present in the intermetallic particle structure formed during the casting of the alloy. An ideal structure in terms of tensile yield strength, however, is one in which all the manganese solute is present in solid solution. Thus, a balance must be struck between the solute being disposed in the intermetallic particle structure or in solid solution to obtain a material that possesses acceptably high strength and acceptably low earing. Despite the apparent need to trade off strength to achieve lower earing, or vice versa, it was surprisingly found according to one aspect of the present invention that strength and earing could be improved simultaneously in the AA 3004 alloy by treating the material during the annealing step at a temperature of from about 1000° to about 1160° F., preferably from about 1100° to about 1150° F., and most preferably from about 1120° to about 1130° F. for up to 24 hours, preferably up to 4 hours and most preferably up to 2 hours. In addition, it was found that this process results in an increase in yield strength without an increase or reduction in earing for the AA 3104 alloy.

According to another aspect of the present invention, it was found that strength could be improved in the AA 3004 alloy with no sacrifice in earing by homogenizing the material according to a one step process in which the material is treated at a temperature of from about 1000° to about 1160° F., preferably from about 1100 to about 1150° F., and most preferably from about 1120° to about 1130° F. for up to 24 hours, preferably up to 4 hours and most preferably up to 2 hours. As used herein the term "one step homogenization process" shall refer to a process in which a cast ingot is heated to a desired homogenization temperature for a desired length of time and is then allowed to cool to a temperature below the desired homogenization temperature range or is immediately hot rolled. The above described one step homogenization process is to be distinguished from the conventional two step process in which a cast ingot is heated to a desired homogenization temperature for a desired length of time and is then heated at a different desired homogenization temperature for a desired length of time.

According to a most preferred method of the present invention, an aluminum alloy is cast into an ingot and the ingot is heated at a temperature of from about 1000° to about 1150° F., preferably about 1125° F., for a period of at least 2 hours, preferably about 4 hours to homogenize the aluminum alloy. The alloy is hot rolled at a temperature of from about 1000° to about 1150° F. to form hot band material. After the heating step, the alloy is hot rolled immediately to minimize the cooling of the alloy between the heating and hot rolling steps. In any event, the alloy is not allowed to cool below about 1000° F. between the heating and hot rolling steps. The hot rolled material is then cold rolled to final gauge. According to this method the aluminum alloy has the following composition: about 0.75 to about 1.15% by weight manganese, about 0.95 to about 1.45% by weight magnesium, about 0.30 to about 0.45% by weight iron, about 0.15 to about 0.25% by weight silicon, about 0.12 to about 0.25% by weight copper, up to about 0.1% by weight chromium, up to about 0.1% by weight zinc, up to about 0.1% by weight titanium and the balance being aluminum. The process results in an aluminum alloy sheet material having improved after bake yield strength.

The degree of solute supersaturation in the alloy has been found to depend very strongly on how the alloy is processed. The degree of solute supersaturation can be monitored very well by electrical resistivity measurements. The electrical resistivity of the material is directly dependent on the degree of solute supersaturation so that the higher the electrical resistivity value, the larger the extent of manganese in solid solution. The degree of solute supersaturation can also be determined by light and electron metallography study of the constitutional and grain structure of the alloy.

It has been determined that the amount of solute in solid solution in aluminum manganese alloys can be made to vary in any of the conventional process steps of (a) casting; (b) preheating or homogenization; (c) hot rolling; or (d) annealing.

It has also been determined that by varying the amount of solute in solid solution in each step prior to the annealing step, the character of a recrystallization process that takes place during the annealing step can be varied. It has also been found that by varying the recrystallization process the earing behavior of the material can be varied.

Generally, the more solute that remains in solid solution immediately prior to the annealing step, the more solid state precipitation occurs during the anneal. A greater degree of solid state precipitation during the anneal inhibits the development of texture component promoting 90° earing and increases the degree of 45° earing obtained during ensuing cold working.

Thus, to produce a material having improved earing it is desirable that as little solute as possible remain in solid solution prior to annealing to inhibit solid state precipitation during annealing. By inhibiting solid state precipitation, higher 90° earing is generated in the annealed condition which results in lower 45° earing in the cold rolled final gauge material. As noted above, however, any process which causes the solute supersaturation to deplete will also cause the yield strength of the material to decrease.

Since the mechanical behavior of aluminum can body stock and end stock material is dependent upon the composition of the material, the processing of the material and the disposition of solute at various processing steps, these factors and their relationship to the processes of the present invention will now be discussed.

The composition range of AA 3004 aluminum alloy is: 1.0–1.5% manganese (Mn), 0.8 1.3% magnesium (Mg), 0.7% iron (Fe) (maximum), 0.3% silicon (Si) (maximum), 0.25% copper (Cu) (maximum), and 0.25% zinc (Zn) (maximum) with the remainder being constituted by aluminum (Al). The AA 3004 aluminum alloy is a non-heat treatable Al Mn alloy to which Mg is added to improve its work hardening characteristics. The major constituents in the AA 3004 alloy are $Al_6(Mn,Fe)$ and $Al_6Mn$. Nagahama et al, Trans J.I.M., Vol. 15 (1974), 185–192; Goel, et al, Aluminium 50, 8 (1974) 511–514.

In the AA 3004 aluminum alloy cast by conventional direct chill casting with an average solidification rate of approximately 1° C./sec, only 25–30% of the Mn is present in intermetallic structures in the cast state while 70–75% is present in solid solution, producing a supersaturated metastable solid solution condition.

The presence of Si in the AA 3004 aluminum alloy introduces three additional primary phases which have been identified as $\alpha$-$Al_{12}(Mn,Fe)_3Si$, $\alpha$-$Al_{20}Fe_5Si_2$, and $\alpha$-$Al_{12}(Mn,Fe)_3Si$. About 85% of the primary intermetallic particles correspond to the orthorhombic phase $Al_6(Mn,Fe)$, while about 15% correspond to the cubic phases $\alpha$and $\alpha'$ of which the majority is $\alpha$-$Al_{12}(Mn,Fe)$hdSi. The $\alpha$ particles are formed either by a eutectic reaction directly from the melt or to a smaller extent by a peritectic reaction from $Al_6(Mn,Fe)$ particles. Goel et al, Aluminium 50, 8 (1974) 511–516; Morris et al, Metal Science, Jan. 1978, 1–7; Warlimont, Aluminium, 53, 3 (1977) 171–176; Furrer, Metal Science, March 1979, 155–162; Rao et al, Zeit. Metallkunde, Bd 74, H. 9, (1983) 585–591; Nes et al, Z. Metallkunde, (1972) 248–252.

At temperatures of approximately 400° F. an aging behavior has been detected in the AA 3004 aluminum alloy with the production of needle-like precipitates of a size of 0.005–0.01 μm in diameter and 0.1–0.2 μm in length. These particles have been tentatively identified as $Mg_2Si$. Chen et al., Scripta Met. 18 (1984), 1365.

The cast state of the AA 3004 aluminum alloy is characterized by a solidification cell structure with the intermetallic compounds of $Al_6(Mn,Fe)$ and $Al_{12}(Mn,Fe)_3Si$ being located in the cell boundaries. The development of these intermetallic compounds is important as they act as nuclei for recrystallization which takes place during the annealing step. The solidification cell size, the degree of solid solution solute supersaturation and the morphology of the intermetallic structure at the cell boundaries are the primary features defining the cast structure. These features in turn are determined by the rate of solidification of the alloy.

The rate of solidification associated with conventional processes for casting the AA 3004 aluminum alloy ranges from 1° C./sec for direct chill casting to 500° C./sec for strip casting.

As the rate of solidification of the alloy increases the solidification cell size decreases. For example, the solidification cell size in direct chill cast alloy material has an average diameter of approximately 50 μm while the solidification cell size in strip cast alloy material has an average diameter of approximately 6–10 μm.

With an increase in solidification rate of the alloy the solid solution solute supersaturation is increased. With the variation in solidification rates previously mentioned, the solid solution solute supersaturation ranges from approximately 0.75% Mn to 0.90% Mn. There is a corresponding inverse relationship between solidification rate and the amount of solute present as intermetallic particles at the cell boundaries. This variation is from 0.50% Mn for direct chill cast material to 0.35% Mn for strip cast material.

In addition to the variation in the amount of intermetallic at the cell boundaries with variation in solidification rate there is a decrease in the thickness of the intermetallic structure with an increase in the rate of solidification of the alloy. In all cases the form of the intermetallic structure at the cell boundaries is eutectic. Thus, the eutectic structure is finer and less massive as the rate of solidification is increased. This has a subsequent effect on the character of the intermetallic particles produced by homogenization.

In conventional processes, homogenization of the AA 3004 aluminum alloy is carried out at a temperature of from 900° F. to 1125° F. Typically, the homogenization process is conducted according to a two-step pattern in which the alloy material is treated at approximately 1125° F. for approximately 4 to 10 hours and is then cooled to approximately 975° F. and maintained at this temperature for approximately 2 hours. Homogenization is conducted for the purposes of (1) making more uniform the cored solute conditions associated with the solidification cells of the cast material and (2) changing the morphology of the intermetallic structure at the cell boundaries from that associated with a eutectic structure to one where the particles are globular and approach an idealized spheroidal shape.

One of the major effects of homogenization is a reduction of the solid solution solute content associated with the cast material. The homogenization temperature has a significant effect on this reduction with the maximum loss in solute supersaturation being obtained at temperatures of from 900 to 925° F. The loss in solute supersaturation is due to two effects. One effect is associated with the thinning, breakup, globularization and coarsening of the intermetallic structure that is initially located at the solidification cell boundaries as a eutectic structure. The other effect is related to the solid state precipitation of $Al_6(Mn,Fe)$ and $Al_6Mn$. Solid state precipitation occurs with a maximum intensity at a homogenization temperature of from 900° to 925° F. At a temperature of 900° F. the solid solution decomposition reaction is so rapid that approximately 80% of the potential loss in solid solution supersaturation occurs within the first two hours of homogenization.

The extent of the loss of solid solution solute content as a function of homogenization temperature is also dependent on the rate of solidification. Strip cast AA 3004 aluminum alloy shows greater temperature dependence in terms of the loss of solid solution solute supersaturation than direct chill cast material. Specifically, strip cast material shows a greater loss of solid solution solute supersaturation in comparison to direct chill cast material at increasing temperatures.

The solid solution solute supersaturation decomposition effect has also been found to depend on the degree of prior plastic strain. For example, as cast AA 3004 alloy shows less temperature dependence in terms of the loss of solid solution solute supersaturation than as cast material that had been cold rolled to a 40% reduction.

The solid state precipitation tendencies of AA 3004 alloy show two hardness peaks, one peak being centered at approximately 450° F. and the other being centered at approximately 900° F. The 450° F. peak appears to be related to the precipitation of $Mg_2Si$ while the 900° F. peak appears to be due mainly to the precipitation of $Al_6(Mn,Fe)$ and $Al_6Mn$. Both of these precipitation reactions contribute to the control of primary recrystallization, recrystallization textures, earing and the deformed state of the AA 3004 aluminum alloy material.

It has been determined that the homogenization process has a substantial effect on the recrystallization behavior of the AA 3004 aluminum alloy. The recrystallization behavior of the AA 3004 aluminum alloy is controlled constitutionally by three factors:

(a) the character of the intermetallic particles present in the alloy;

(b) the amount of solute in solid solution immediately prior to the annealing treatment; and (c) the density, size and distribution of solid state reaction formed precipitates or dispersoids present in the alloy immediately prior to annealing.

It has been found that the particular homogenization practice employed impacts all of the factors mentioned above. In the case of intermetallic particles which originate in the cast structure, the shape and size of these particles after homogenization are very important considerations for controlling the primary recrystallization process. As noted above, the $Al_6(Mn,Fe)$ and $\alpha$-$Al_{12}(Mn,FE)_3Si$ intermetallic particles act as nuclei for recrystallization during the annealing step. If these particles are globular in form, have a size of from 2 to 10 μm and are somewhat randomly distributed, they promote the formation of a uniform, equiaxed and relatively small recrystallized grain structure of which there is a significant fraction that is "cube oriented". However, if the particles are angular and elongated which results from an inadequate homogenization practice, the grain structure tends to be mixed in terms of size and shape. Es-Said et al., Inst. Metals, 1987, 333–338. Some of the grains that are nucleated at the ends of these particles are equiaxed; others that form along the sides of the particles are elongated. If the intermetallic particles are too small, having a diameter of 1 μm or less, they do not act as effective nucleation sites for the recrystallized grain structure and a significant loss in potential cube oriented material occurs.

The amount of solute in solid solution immediately prior to the annealing operation is an important factor in controlling the character and kinetics of the recrystallization process. An increase in solute supersaturation immediately prior to annealing results in a significant increase in the degree of dynamic precipitation that occurs during annealing. An increase in the degree of dynamic precipitation during annealing concomitantly drastically increases the incubation time for recrystallization which indicates a reduction in the nucleation rate for recrystallization. A large reduction in the nucleation rate due to intense dynamic precipitation increases the volume fraction of recrystallized grains of the type (non cube oriented) which lead to an increase in the 45° earing of the material. Thus, recrystallization is inhibited by an increased degree of solute supersaturation in the material immediately prior to annealing which leads to an increase in the 45° earing of the final gauge material.

The density of the solid state reaction formed precipitates or dispersoids also impacts the ability of the intermetallic particles to act as nucleation sites for recrystallization. If the density of the dispersoids is very large, the dispersoids render the intermetallic particles less effective as nucleation sites for recrystallization. Additionally, the dispersoids have been found to inhibit grain growth of the recrystallized grains. A high homogenization temperature, such as 1125° F., yields material with a significantly greater solid solution solute content than material subjected to a low homogenization temperature, such as 900° F. Because of this higher solid solution solute content a greater pinning effect on the dislocation structure is produced by the greater decomposition or precipitation effect that results when the material is annealed. Thus, the development of a polygonized structure and the subsequent production of recrystallization nuclei is inhibited in material subjected to a high homogenization temperature. The volume fraction of the material which has a cube orientation is therefore restricted.

The recrystallization behavior of AA 3004 aluminum alloy material has been found to be an important factor in the control of the earing behavior in the final gauge material. Material may be processed so that either static or dynamic recrystallization occurs, however, statically recrystallized material has been found to yield poorer earing behavior as compared to dynamically recrystallized material. This result is related to the minimization of the dislocation pinning effect of the fine dispersoid during recrystallization if recrystallization occurs dynamically as contrasted to statically. For dynamic recrystallization to occur, the hot working temperature must be relatively high and above a critical temperature for a certain strain level. For the material to be statically recrystallized, the hot working temperature must be maintained relatively low to produce a dynamically unrecrystallized structure and one which has a sufficiently high dislocation density that causes the occurrence of static recrystallization during a subsequent anneal. Hot working the material at a relatively low temperature maintains a high supersaturation level of Mn prior to recrystallization which results in a high degree of dynamic precipitation during the anneal. During high temperature hot working, however, dynamic precipitation is minimized and dynamic recrystallization occurs without a significant pinning effect of the dense dispersoid. It is, therefore, easier to maximize the cube and near cube texture components in the AA 3004 aluminum alloy during dynamic recrystallization (hot working) as contrasted to static recrystallization (annealing).

In terms of earing behavior, it has been found that the resistance to loss in 90° earing is much greater in dynamically recrystallized material than in statically recrystallized material.

In terms of 45° earing, it has been found that the valleys (negative earing) are initially greater in dynamically recrystallized material and resist becoming ears to a greater degree with increase in strain when compared to the statically recrystallized material.

Peak earing is a measure of the maximum earing regardless of the position from the rolling direction (45°, 90° or any other angle). In statically recrystallized material, it was found that peak earing and 90° earing coincide position wise up to approximately a 40% cold reduction. After this amount of strain the peak earing rotated increasingly away from the 90° position with increase in strain. In dynamically recrystallized material, it was found that peak earing and 90° earing coincided up to approximately a 75% cold reduction. This is an indication of the greater plastic stability of 90° ears in the dynamically recrystallized material.

It has also been found that if the volume fraction of grains with cube or near cube orientation in the dynamically recrystallized state is low then the intensity and stability of 90° ears at the hot band stage is also low.

If the volume fraction of grains with cube or near cube orientation in the dynamically recrystallized state is high, however, then the intensity of 90° ears in the hot band is also high.

Thus, by controlling simultaneously the intermetallic particle structure, the dispersoid structure and the amount of solute in solid solution an optimum dynamically recrystallized hot band grain structure can be produced during hot working which maximizes the volume fraction of cube or near cube texture components. This controlled processing yields a material in which the positive 90° earing is made reasonably stable, the negative 45° earing is also made stable and therefore the peak earing is rendered stable. Thus, controlled processing yields a material with low earing behavior at high levels of strain.

It has been determined that there are certain fundamental considerations that will lead to low earing in the final gauge, H19 condition of the AA 3004 aluminum alloy. Some of these fundamental considerations are:

(a) Homogenization is carried out at those temperatures and times that enable the development of a strong cube texture after hot working and annealing of direct chill cast material.

(b) Hot working procedures are employed to develop a well defined polygonized dislocation structure which enables the production of a strong cube texture during annealing of the direct chill cast material.

(c) The production of low solute supersaturation at the anneal stage along with high annealing temperature favors the development of a cube texture during annealing which leads to low earing in the H19 material.

The present invention will now be described in more detail with reference to the following examples. These examples are merely illustrative of the present invention and are not intended to be limiting.

Example 1

Conventional AA 3004 aluminum alloy hot band material that was either annealed or unannealed was obtained from an Aluminum Inc. The material had a thickness of 0.090 gauge. Samples of the unannealed and annealed material were annealed for 2 hours at a temperature of 700° F., 800° F., 975° F. or 1125° F. and then cold rolled. In each case the material was cold rolled to 0.045 gauge and then to 0.012 gauge.

Earing tests were conducted on the materials at the hot band gauge, 0.045 gauge and 0.012 gauge.

Tension tests were conducted on the materials at the 0.012 gauge before and after baking at 400° F. for 10 minutes.

The results are shown in Tables 1-6 below and FIGS. 1-5.

TABLE 1

Material: 3004 #917063
This material was self-annealed as it was annealed during hot working.

| | 0.090" gauge | | 0.045" gauge | | 0.012" gauge | |
|---|---|---|---|---|---|---|
| | Earing | | | | | |
| CONDITION | 90° | 45° | 90° | 45° | 90° | 45° |
| At Hot band gauge (as received) | 4.3 | | 3.4 | | | 1.7 |
| 700° F. × 2 hrs | 4.6 | | 3.5 | | | 1.7 |
| 800° F. × 2 hrs | 5.3 | | 3.6 | | | 1.6 |
| 975° F. × 2 hrs | 5.4 | | 3.9 | | | 1.5 |
| 1125° F. × 2 hrs | 6.6 | | 6.6 | | | 1.0 |

TABLE 2

Material: 3004 #917252
This material was annealed prior to cold rolling.

| | 0.090" gauge | | 0.045" gauge | | 0.012" gauge | |
|---|---|---|---|---|---|---|
| | Earing | | | | | |
| CONDITION | 90° | 45° | 90° | 45° | 90° | 45° |
| At Hot band gauge (as received) | 4.2 | | 3.0 | | | 1.9 |
| 700° F. × 2 hrs | 5.0 | | 3.0 | | | 1.9 |
| 800° F. × 2 hrs | 5.0 | | 3.0 | | | 1.9 |
| 975° F. × 2 hrs | 5.2 | | 3.5 | | | 1.7 |
| 1125° F. × 2 hrs | 6.5 | | 6.2 | | | 1.3 |

TABLE 3

Material: 3004 #917258
This material was cold rolled before it was annealed.

| | 0.090" gauge | | 0.045" gauge | | 0.012" gauge | |
|---|---|---|---|---|---|---|
| | Earing | | | | | |
| CONDITION | 90° | 45° | 90° | 45° | 90° | 45° |
| At Hot band gauge | | 7.0 | | | | |

TABLE 3-continued

| Material: 3004 #917258 This material was cold rolled before it was annealed. | | | | | | |
|---|---|---|---|---|---|---|
| | 0.090" gauge | | 0.045" gauge | | 0.012" gauge | |
| | Earing | | | | | |
| CONDITION | 90° | 45° | 90° | 45° | 90° | 45° |
| (as received) | | | | | | |
| 700° F. × 2 hrs | 3.6 | | 2.1 | | | 2.5 |
| 800° F. × 2 hrs | 3.7 | | 2.2 | | | 2.3 |
| 975° F. × 2 hrs | 4.0 | | 2.4 | | | 2.3 |
| 1125° F. × 2 hrs | 5.8 | | 4.0 | | | 2.0 |

TABLE 6-continued

| Material: 3004 #917252 | |
|---|---|
| ANNEALING CONDITION | ELECTRICAL RESISTIVITY $\rho(\mu\Omega\text{-cm})$ |
| 800° F. × 2 hrs | 4.74 |
| 975° F. × 2 hrs | 4.94 |
| 1125° F. × 2 hrs | 5.70 |

Figure 2:
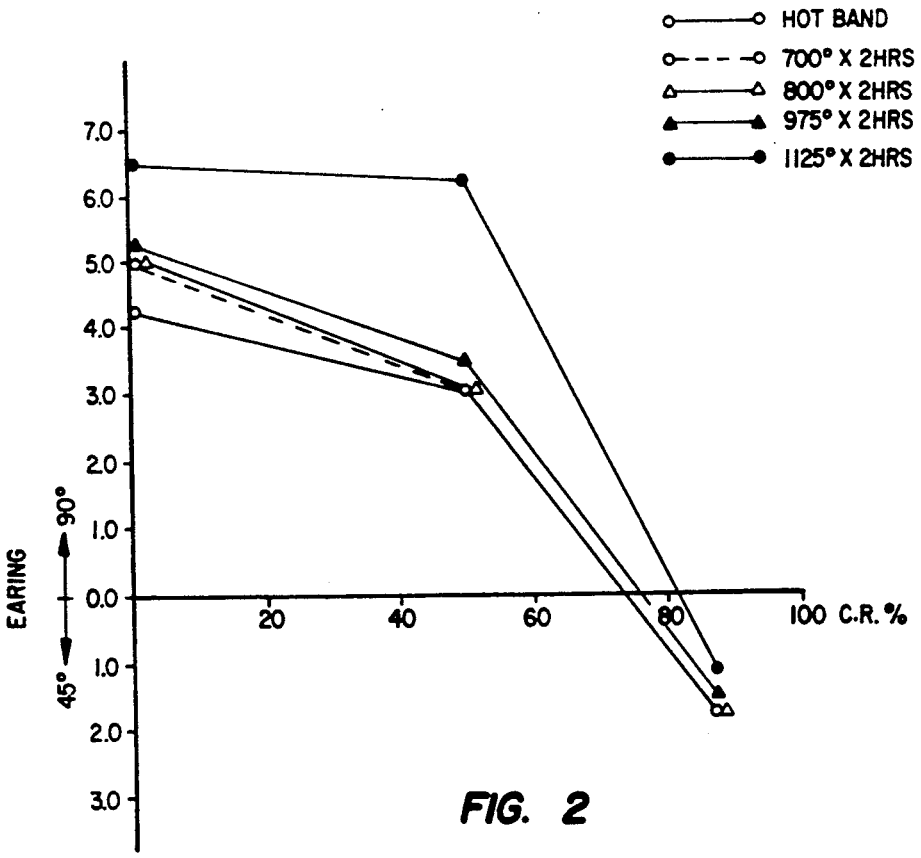
FIG. 2 is a graph of earing versus percent cold rolling for various samples of the AA 3004 aluminum alloy.
Figure 3:
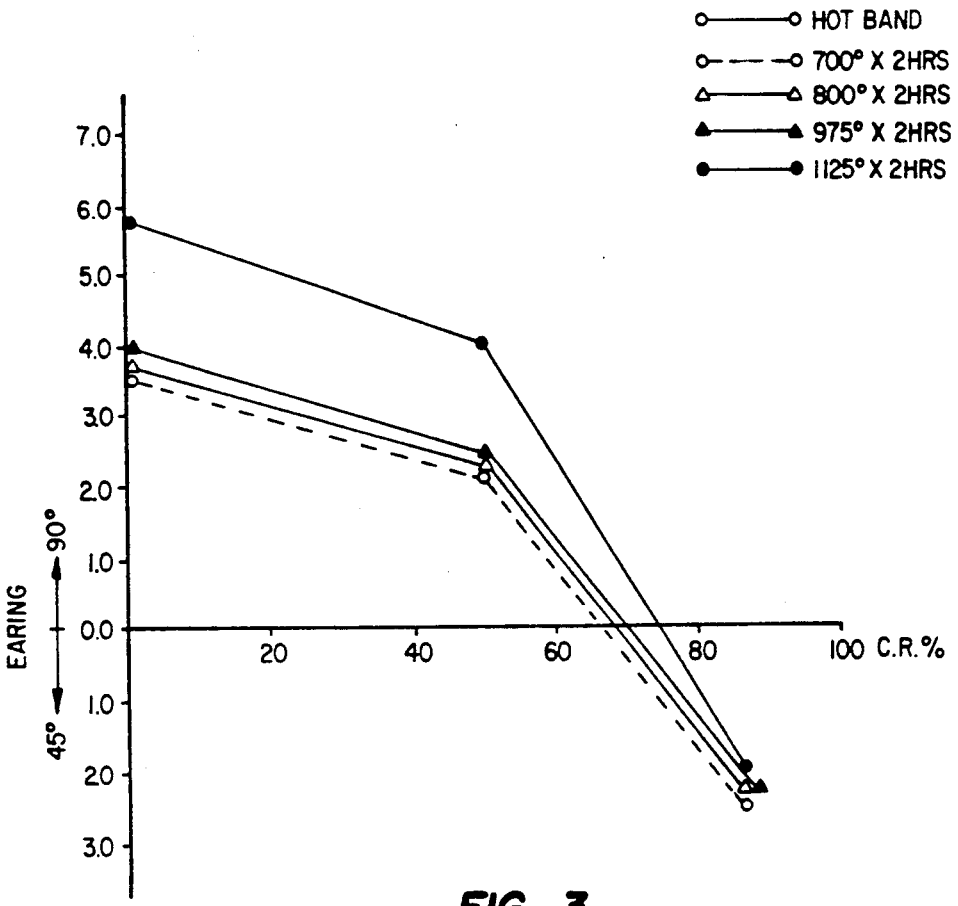
FIG. 3 is a graph of earing versus percent cold rolling for various samples of the AA 3004 aluminum alloy.

The results shown in Tables 1-3 and FIGS. 1-3 reveal that after annealing the hot band material at 1125° F. for 2 hours a significant change in the earing behavior of the material is generated. Specifically, the 90° earing value is significantly increased at both the hot band and 0.045 gauge, which results in an advantageous reduction of the 45° earing at the final 0.012 gauge. From these results it was determined that if a higher 90° earing can be generated in the annealed condition of the alloy, then the 45° earing at the final gauge of H-19 condition will be advantageously lower.

TABLE 4

| | BEFORE BAKING | | | AFTER BAKING* | | |
|---|---|---|---|---|---|---|
| CONDITION | Tensile Yield Strength (ksi) | Ultimate Tensile Strength (ksi) | Elongation (%) | Tensile Yield Strength (ksi) | Ultimate Tensile Strength (ksi) | Elongation (%) |
| Hot band material** Cold Rolled to 0.0120" gauge | 41.5 | 43.3 | 1.5 | 35.5 | 40.5 | 5.0 |
| Hot band material + 700° F. × 2 hrs Cold Rolled to 0.0120" gauge | 41.3 | 43.5 | 1.5 | 35.7 | 41.3 | 5.0 |
| Hot band material + 800° F. × 2 hrs Cold Rolled to 0.0120" gauge | 41.4 | 43.6 | 1.5 | 36.3 | 42.0 | 5.0 |
| Hot band material + 975° F. × 2 hrs Cold Rolled to 0.0120" gauge | 41.4 | 43.6 | 1.5 | 37.3 | 42.0 | 5.5 |
| Hot band material + 1125° F. × 2 hrs Cold Rolled to 0.0120" gauge | 43.0 | 45.0 | 1.7 | 40.5 | 44.4 | 6.0 |

*Baked in circulative air furnace at 400° F. for 10 minutes
**AA 3004 alloy coil #917252, annealed, hot band gauge 0.090"

TABLE 5

| | BEFORE BAKING | | | AFTER BAKING* | | |
|---|---|---|---|---|---|---|
| CONDITION | Tensile Yield Strength (ksi) | Ultimate Tensile Strength (ksi) | Elongation (%) | Tensile Yield Strength (ksi) | Ultimate Tensile Strength (ksi) | Elongation (%) |
| Hot band material** Cold Rolled to 0.0120" gauge | 42.5 | 43.5 | 1.5 | 35.6 | 40.2 | 5.0 |
| Hot band material + 700° F. × 2 hrs Cold Rolled to 0.0120" gauge | 41.5 | 42.3 | 1.5 | 35.0 | 39.7 | 5.0 |
| Hot band material + 800° F. × 2 hrs Cold Rolled to 0.0120" gauge | 42.5 | 43.6 | 1.5 | 36.2 | 40.6 | 5.0 |
| Hot band material + 975° F. × 2 hrs Cold Rolled to 0.0120" gauge | 42.3 | 43.3 | 1.5 | 37.5 | 42.2 | 5.0 |
| Hot band material + 1125° F. × 2 hrs Cold Rolled to 0.0120" gauge | 43.2 | 44.0 | 1.7 | 41.0 | 44.8 | 6.0 |

*Baked in circulative air furnace at 400° F. for 10 minutes
**AA 3004 alloy coil #917063, self-Annealed, hot band gauge 0.090"

TABLE 6

| Material: 3004 #917252 | |
|---|---|
| ANNEALING CONDITION | ELECTRICAL RESISTIVITY $\rho(\mu\Omega\text{-cm})$ |
| Hot Band | 4.73 |
| 700° F. × 2 hrs | 4.75 |

Figure 4:
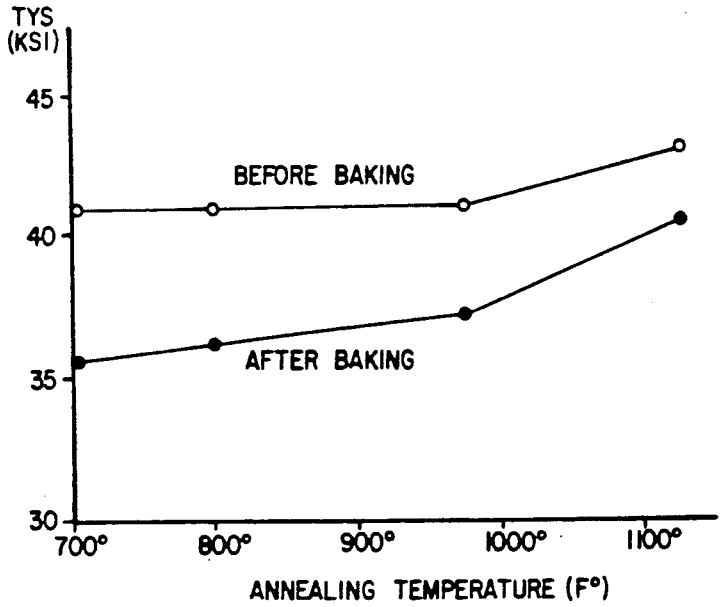
FIG. 4 is a graph of tensile yield strength versus annealing temperature for the AA 3004 aluminum alloy before and after baking at 400° F. for 10 minutes in a circulative air furnace.
Figure 5:
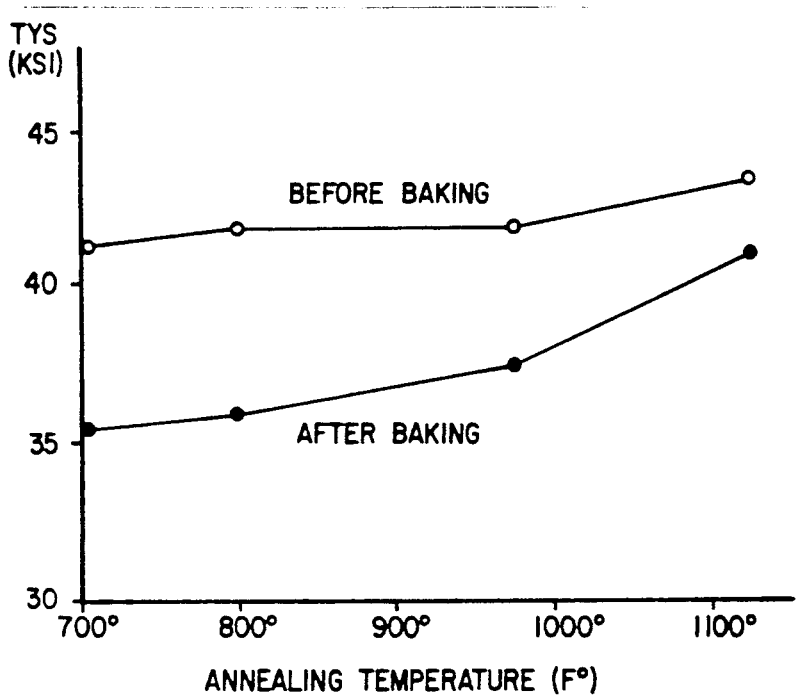
FIG. 5 is a graph of tensile yield strength versus annealing temperature for the AA 3004 aluminum alloy before and after baking at 400° F. for 10 minutes in a circulative air furnace.

The results shown in Tables 4–5 and FIGS. 4–5 reveal that after annealing the hot band material at 1125° F. for 2 hours a significant change in the tensile yield strength of the material is also generated. Specifically, the tensile yield strength is significantly increased both before and after baking in a circulative air furnace of 400° F. for 10 minutes.

In addition, as shown in Table 6, the electrical resisitivity of the material increases from about 4.7 μΩ-cm to about 5.7 || Ω-cm, which indicates that the alloy has been re-supersaturated. The re-supersaturation of the material increases the yield strength of the material and reinforces its resistance to baking.

The mechanism for the super-strengthening of the AA 3304 alloy is solid solution hardening which depends on supersaturation of manganese (Mn). The more Mn is retained in solid solution, The higher the resistivity and the better the baking resistance of the material.

Example 2

Conventional AA 3104 aluminum alloy hot band material was obtained from Logan Aluminum Inc. This material had a chemical composition of 0.200% Si, 0.470% Fe, 0.300% Cu, 0.980% Mn, and 1.360% Mg with the remainder being constituted by Al. The hot band material was received at 0.120 gauge and was cold rolled to 0.090 gauge.

After the above-mentioned cold rolling step, samples of the material were annealed for 2 hours at temperatures of 700° F., 800° F., 975° F. or 1125° F. After annealing , the samples were cold rolled to 0.045 gauge and then to 0.012 gauge.

Earing tests were conducted on the materials at the 0.090 gauge, 0.045 gauge and 0.012 gauge.

Tension tests were conducted on the materials at the 0.012 gauge before and after baking in a circulative air furnace at 400° F. for 10 minutes.

Figure 6:
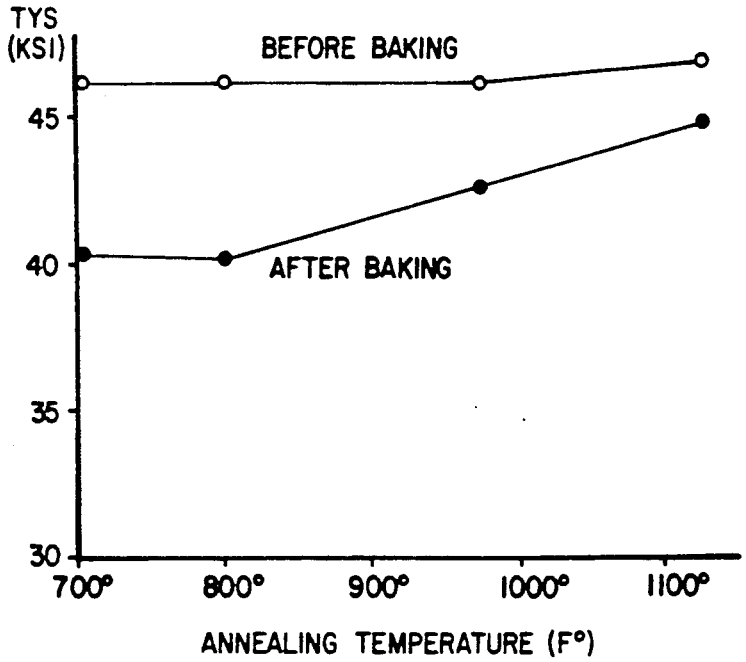
FIG. 6 is a graph of tensile yield strength versus annealing temperature for the AA 3104 aluminum alloy before and after baking at 400° F. for 10 minutes in a circulative air furnace.
Figure 7:
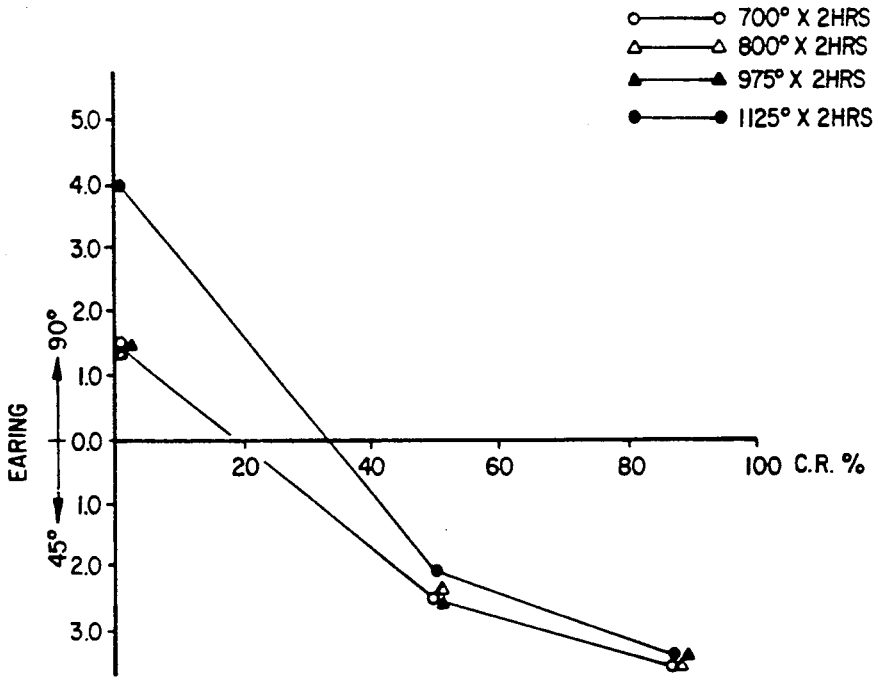
FIG. 7 is a graph of earing versus percent cold rolling for various samples of the AA 3104 aluminum alloy; and, FIG. 8 is a graph of electrical resistivity versus time at various temperatures for samples of the homogenized AA 3004 aluminum alloy.

The results are shown in Tables 7–9 and FIGS. 6–7.

TABLE 7

| | Material: 3104-89 #272082 | | | | | |
|---|---|---|---|---|---|---|
| | BEFORE BAKING | | | AFTER BAKING* | | |
| CONDITION | Tensile Yield Strength (ksi) | Ultimate Tensile Strength (ksi) | Elongation (%) | Tensile Yield Strength (ksi) | Ultimate Tensile Strength (ksi) | Elongation (%) |
| Hot band + 25% C.R. + 700° F. × 2 hrs Cold Rolled to 0.0120" gauge | 46.5 | 47.2 | 1.5 | 40.5 | 45.0 | 5.5 |
| Hot band + 25% C.R. + 800° F. × 2 hrs Cold Rolled to 0.0120" gauge | 46.6 | 47.3 | 1.5 | 40.2 | 45.0 | 5.5 |
| Hot band + 25% C.R. + 975° F. × 2 hrs Cold Rolled to 0.0120" gauge | 46.8 | 47.2 | 1.5 | 42.5 | 47.0 | 6.5 |
| Hot band + 25% C.R. + 1125° F. × 2 hrs Cold Rolled to 0.0120" gauge | 47.0 | 47.5 | 1.5 | 45.0 | 48.0 | 6.5 |

TABLE 8

| | Material: 3104-89 #272082 | | | | | |
|---|---|---|---|---|---|---|
| | 0.090" gauge | | 0.045" gauge | | 0.012" gauge | |
| | Earing | | | | | |
| CONDITION | 90° | 45° | 90° | 45° | 90° | 45° |
| At Hot band gauge (as received) | | | | | | |

TABLE 8-continued

| | Material: 3104-89 #272082 | | | | | |
|---|---|---|---|---|---|---|
| | 0.090" gauge | | 0.045" gauge | | 0.012" gauge | |
| | Earing | | | | | |
| CONDITION | 90° | 45° | 90° | 45° | 90° | 45° |
| 700° F. × 2 hrs | 1.5 | | | 2.5 | | 3.4 |
| 800° F. × 2 hrs | 1.4 | | | 2.3 | | 3.5 |
| 975° F. × 2 hrs | 1.4 | | | 2.7 | | 3.8 |
| 1125° F. × 2 hrs | 4.0 | | | 2.0 | | 3.4 |

TABLE 9

| Material: 3104-89 #272082 | |
|---|---|
| ANNEALING CONDITION | ELECTRICAL RESISTIVITY ρ(μΩ-cm) |
| Hot Band | 4.77 |
| 700° F. × 2 hrs | 4.80 |
| 800° F. × 2 hrs | 4.75 |
| 975° F. × 2 hrs | 4.91 |
| 1125° F. × 2 hrs | 5.50 |

The results shown in Table 7 and FIG. 6 reveal that after annealing at 1125° for 2 hours, a significant change in the tensile yield strength is generated in hot band material that had been cold rolled to 0.090 gauge. Specifically, the tensile yield strength was increased to 47.0 ksi before baking and 45.0 ski after baking in a circulative air furnace at 400° F. for 10 minutes.

In addition, as shown in Table 9, the electrical resistivity of the material increased from about 4.7 μΩ-cm to about 5.5 μΩ-cm, which indicates that the alloy has been re-supersaturated. The re-supersaturation of the material increased the yield strength of the material and reinforces its resistance to baking. The mechanism for the super-strengthening of the 3104 alloy is also solid solution hardening which depends on supersaturation of manganese (Mn).

The results shown in Table 8 and FIG. 7 reveal that after annealing at 1125° F. for 2 hours there was essentially no change in the earing behavior of the hot band material that had been cold rolled to 0.090 gauge.

EXAMPLE 3

It was determined according to this example that the baking resistance of AA 3004 and AA 3104 alloys could be increased by modifying the homogenization process.

The experimental design was as follows: as cast material having a thickness of 0.170" was homogenized according to either a one-step or two-step operation. The one-step operation involved heating the material at 1125° F. for four hours while the two-step operation involved heating the material first at 1125° F. for four hours and then at 975° F. for two hours. In either case, the homogenized material was hot rolled immediately following homogenization to a thickness of 0.100" which amounted to a 40% reduction in thickness from the cast state. After hot rolling, in both cases the material was annealed at 700° F. for two hours. The results of yield strength and earing tests conducted on the materials are shown in Tables 10 and 11 below.

TABLE 10

Yield strength and electrical resistivity for 3004-H19 and 3104-H19 after different processing

| | TYS after baking | | Resistivity (μΩ-cm) | |
|---|---|---|---|---|
| Process | 3004 | 3104 | 3004 | 3104 |
| Commercial | 35 ksi | 37 ksi | 4.70 | 4.60 |
| Modified Anneal (Examples 1 and 2) | 40–41 | 45 | 5.70 | 5.50 |
| Modified Homogenization (one-step process) | 40–41 | — | 5.70 | — |

Table 10 reveals the relationship between resistivity and the after-bake yield strength using different processes. The material produced by the one-step homogenization process has increased strength compared to materials produced according to the prior art commercial two-step homogenization process.

Figure 8:
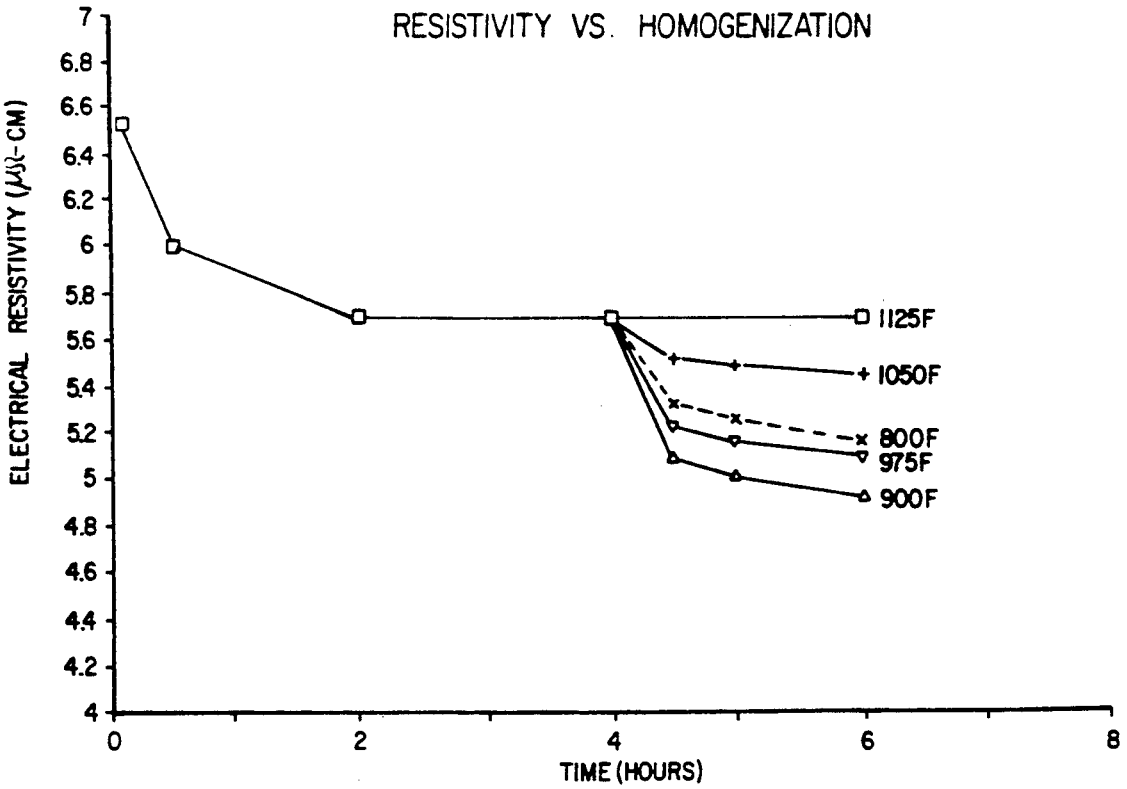

FIG. 8 shows the dependence of electrical resisitivity and thus strength on temperature and time after the completion of homogenization. FIG. 8 reveals that for the modified homogenization process, the optimum results are obtained when hot rolling is commenced immediately after homogenization as the resistivity and thus the strength of the material drops rapidly with the passage of time and especially with a decrease in temperature.

TABLE 11

Results of earing tests comparing one and two step preheating.

| Condition | Earing (45°) | Average (45°) |
|---|---|---|
| one step | 6.9, 6.5, 4.8, 6.3, 4.2 | 5.7 |
| two step | 5.8, 5.9, 7.0, 3.3, 6.8 | 5.8 |

Table 11 reveals that the one-step homogenization process essentially does not change the earing behavior of the material when compared to materials produced according to the current commercial two step homogenization process.

Although preferred embodiments of the present invention have been described in some detail herein, various substitutions and modifications may be made to the methods of the invention without departing from the spirit and scope of the appended claims.

What is claimed is:

1. A method of producing aluminum alloy sheet material, comprising the following steps in the sequence set forth:

casting an aluminum alloy into an ingot;

heating said ingot at a temperature of from about 1000° to about 1150° F. for a period of at least two hours to homogenize said aluminum alloy;

hot rolling said homogenized alloy at a temperature of from about 1000 to about 1150° F. to form hot band material having a thickness of from about 0.080 inches to about 0.130 inches; and cold rolling said hot band material to final gauge.

2. A method according to claim 1, wherein said heating step is conducted at about 1125° F. for about 4 hours.

3. A method according to claim 1, wherein said homogenized alloy is immediately hot rolled after said heating step.

4. A method according to claim 1, wherein said homogenized alloy is not allowed to cool below about 1000° F. between said heating step and said hot rolling step.

5. A method according to claim 1, wherein said homogenized alloy is kept at a temperature of from about 1000 to about 1150° F. between said heating step and said hot rolling step.

6. A method according to claim 1, wherein said aluminum alloy is strip cast into an ingot.

7. A method according to claim 1, wherein said aluminum alloy is direct chill cast into an ingot.

8. The product produced by the process of claim 1.

9. A method according to claim 2, wherein said hot rolling step is conducted at about 1125° F.

10. A method of producing aluminum sheet material, consisting of the steps of:

casting an aluminum alloy ingot;

heating said ingot at a temperature of from about 1000° to about 1150° F. for a period of at least two hours to homogenize said aluminum alloy;

hot rolling said homogenized alloy at a temperature of from about 1000 to about 1150° F. to form hot band material having a thickness of from about 0.080 inches to about 0.130 inches; and cold rolling said hot band material to final gauge.

* * * * *